US009139946B2

(12) United States Patent
Dogan et al.

(10) Patent No.: US 9,139,946 B2
(45) Date of Patent: Sep. 22, 2015

(54) WASHING MACHINE WHEREIN THE TYPE AND AMOUNT OF LAUNDRY CAN BE DETECTED

(75) Inventors: Omer Dogan, Istanbul (TR); Burak Asureciler, Istanbul (TR); Cemal Murat Dora, Istanbul (TR); Eyyup Gokceimam, Istanbul (TR); Ergun Kiran, Istanbul (TR)

(73) Assignee: Arcelik Anonim Sirketi, Istanbul (TR)

( * ) Notice: Subject to any disclaimer, the term of this patent is extended or adjusted under 35 U.S.C. 154(b) by 500 days.

(21) Appl. No.: 13/520,181

(22) PCT Filed: Dec. 23, 2010

(86) PCT No.: PCT/EP2010/070711

§ 371 (c)(1),
(2), (4) Date: Oct. 8, 2012

(87) PCT Pub. No.: WO2011/080231

PCT Pub. Date: Jul. 7, 2011

(65) Prior Publication Data

US 2013/0133379 A1 May 30, 2013

(30) Foreign Application Priority Data

Dec. 31, 2009 (TR) ..... a 2009 10094

(51) Int. Cl.
*D06F 39/00* (2006.01)
*D06F 33/02* (2006.01)

(52) U.S. Cl.
CPC ..... *D06F 39/00* (2013.01); *D06F 33/02* (2013.01); *D06F 39/003* (2013.01); *D06F 2202/10* (2013.01)

(58) Field of Classification Search
CPC ..... D06F 39/003; D06F 39/00; D06F 33/02; D06F 2202/10
USPC ..... 68/12.04, 12.05, 12.21, 12.23
See application file for complete search history.

(56) References Cited

U.S. PATENT DOCUMENTS

| | | | | |
|---|---|---|---|---|
| 5,259,217 | A * | 11/1993 | Civanelli et al. | 68/12.04 |
| 5,897,672 | A * | 4/1999 | Badami et al. | 8/159 |
| 6,023,950 | A * | 2/2000 | Battistella | 68/12.04 |
| 6,634,191 | B1 * | 10/2003 | Guler et al. | 68/12.04 |
| 8,220,092 | B2 * | 7/2012 | Schulze | 8/159 |
| 8,220,292 | B2 * | 7/2012 | Czyzewski et al. | 68/12.05 |
| 2006/0107468 | A1 * | 5/2006 | Urbanet et al. | 8/158 |
| 2006/0283214 | A1 * | 12/2006 | Donadon et al. | 68/211 |
| 2012/0312055 | A1 * | 12/2012 | Fagstad et al. | 68/12.04 |

* cited by examiner

*Primary Examiner* — Joseph L Perrin
(74) *Attorney, Agent, or Firm* — Venjuris PC

(57) ABSTRACT

In the In a washing machine (1) the type of the laundry placed in the drum (2) and the amount of laundry are estimated by detecting the laundry type information by the valve (4) opening pressure level (Pva1) and the valve (4) closing pressure level (Pvu1) in the water receiving step.

3 Claims, 1 Drawing Sheet

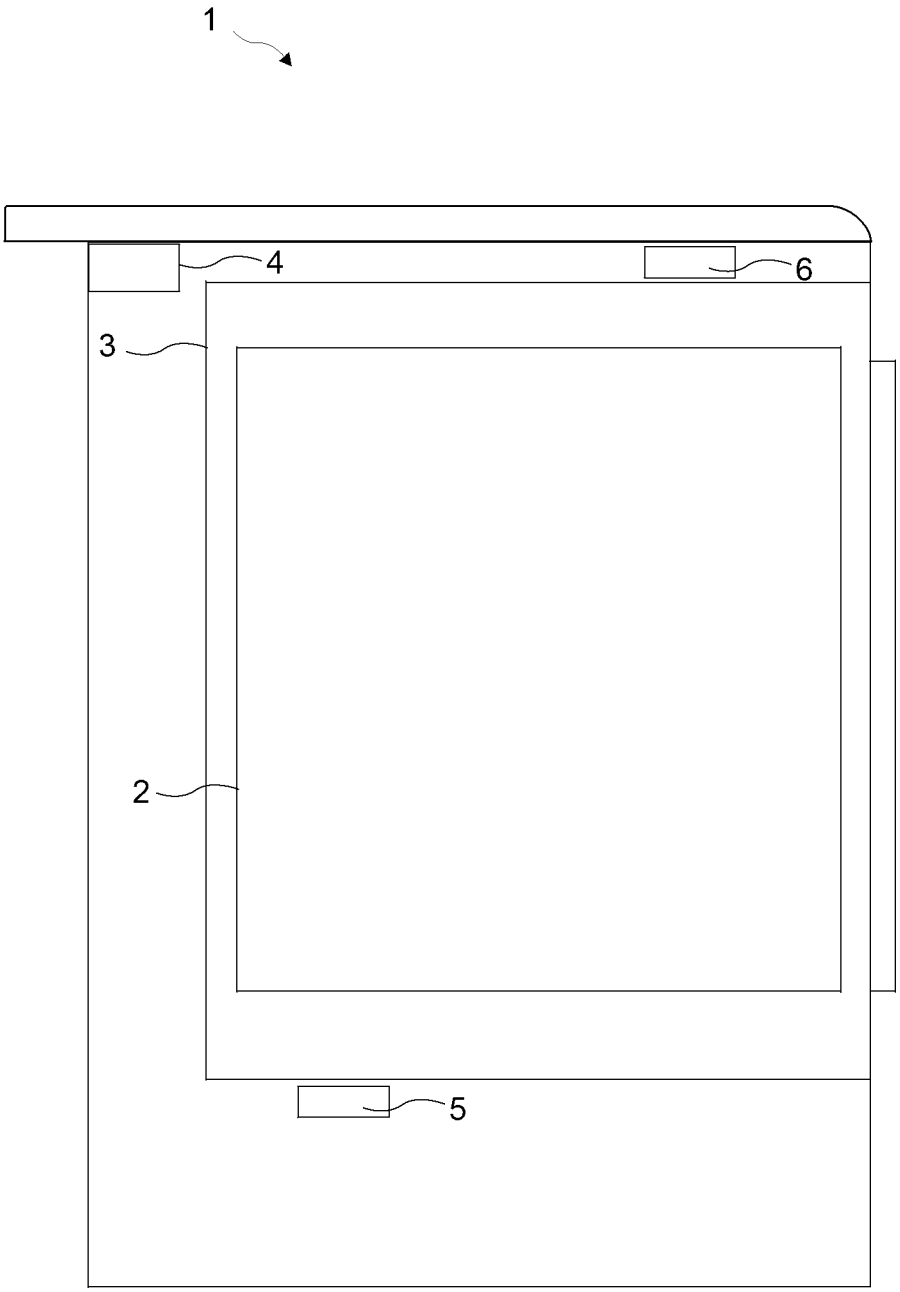
1
4
6
3
2
5

WASHING MACHINE WHEREIN THE TYPE AND AMOUNT OF LAUNDRY CAN BE DETECTED

The present invention relates to a washing machine wherein the type and amount of laundry therein is detected.

In washing machines, one of the most important variables that is effective on the washing performance is the type and weight of the laundry (load) placed in the drum by the user. If these two variables relating to the load can be detected, the amounts of water and detergent to be used and the washing time can be determined. Accordingly, it is possible to operate the washing machine by using as minimum as possible amounts of energy, water and detergent.

In some of the existing embodiments, various sensors are used in order to measure the load that the user places in the drum. However, the use of additional sensors is an embodiment that increases the cost of the machine and also has various difficulties.

In the state of the art German Patent Application No. DE10104682, an electrically insulated surface, functioning as the capacitor between the drum and body is used as the load sensor.

The aim of the present invention is to realize a washing machine wherein the type and amount of the load in the drum is identified easily at the start of the washing process.

The washing machine realized in order to attain the aim of the present invention, described in the first claim and the respective claims thereof, comprises a control unit that provides to determine first the type of load and then the amount of load at the start of the washing program.

The control unit provides water to be received into the tub without directing over the laundry in the amount not wetting the laundry loaded in the drum. The water level in the tub remains below the lowest point of the drum. Afterwards, the type of load is determined by the control unit that rotates the drum several times then compares the pressure values measured by the pressure sensor with the threshold values predetermined by the producer. The control unit provides water to be received into the tub in the amount to wet the laundry without entirely saturating the laundry with water in order to determine the type and character of the laundry loaded in the drum. The water received into the tub is at the lowest level that provides the laundry at the lowermost place in the drum to touch the water. The drum is continuously rotated by the control unit while receiving water to provide the laundry to absorb the water reaching into the drum. After the water receiving process, the motion of the drum is stopped and after waiting for a predetermined period of time, the type of the load is determined by comparing the pressure values measured by the pressure sensor with the threshold values predetermined by the producer.

After the type of the load is determined by the control unit, in the water receiving step performed depending on the values measured by the pressure sensor, the limit pressure values where the valve is opened and closed are determined according to the type of the load. Accordingly, the errors relating to the type of laundry that can be made are minimized in the water receiving step wherein the amount of the load is determined.

By means of the present invention, the determined laundry type information is provided to be reliable by means of first determining the type of the load and the water received into the tub in this phase to be as much as to wet the laundry without entirely absorbing the water.

By means of the present invention, the calculated information of the amount of laundry based on the number of times the valve opens and closes in the water receiving step by the valve opening pressure level (Pva1) and the valve closing pressure level (Pvu1) changing with respect to the type of laundry is provided to be reliable.

A washing machine realized in order to attain the aim of the present invention is illustrated in the attached figures, where:

FIG. 1—is the schematic view of a washing machine.

The elements illustrated in the figures are numbered as follows:

1. Washing machine
2. Drum
3. Tub
4. Valve
5. Pressure sensor
6. Control unit The washing machine (1) of the present invention comprises a drum (2) wherein the laundry to be washed is placed, a tub (3) wherein the drum (2) is disposed, a valve (4) that provides water to be received by opening/closing the water conduit, a pressure sensor (5) that detects the pressure exerted by the water received into the tub (3) and a control unit (6) that determines the type and amount of the load by evaluating the data received from the pressure sensor (5) (FIG. 1).

At the start of the washing program, the control unit (6) by opening the valve (4) provides water to be received into the tub (3) until the water height therein reaches the level to wet the laundry without entirely saturating the laundry, provides the pressure to be measured by the pressure sensor (5) after the drum (2) is rotated, determines the laundry type by comparing the measured instantaneous pressure values (Pa1, Pa2, . . . ) with the threshold values (Pe1, Pe2, . . . ) prerecorded in the memory thereof by the producer, executes the water receiving step by opening/closing the valve (4) according to different closing pressure level (Pvu1, Pvu2, . . . ) values for each laundry type and different opening pressure level (Pva1, Pva2, . . . ) values for each laundry type and determines the amount of laundry by comparing the number of valve (4) openings (V) in the water receiving step with the threshold values (M1, M2, . . . ) prerecorded in the memory thereof by the producer.

In an embodiment of the present invention, when the washing machine (1) is started to operate by selecting the washing program, after water is received by the valve (4) being opened by the control unit (6) and the drum (2) is rotated several revolutions, the instantaneous pressure value (Pa1) measured by the pressure sensor (5) is compared with a first threshold value (Pe1) and a second threshold value (Pe2) that is greater than the first threshold value (Pe1) and if Pa1 is smaller than Pe1, then it is decided that the laundry type is "cotton". If the measured instantaneous pressure value (Pa1) is greater than the second threshold value (Pe2), then the control unit (6) decides that the laundry type is "synthetic". If the instantaneous pressure value (Pa1) remains between the first threshold value (Pe1) and the second threshold value (Pe2), then the control unit (6) rotates the drum (2) several times around the axis thereof and provides circulation of the water in the tub (3). After the said process, the control unit (6) compares the instantaneous pressure value (Pa2) measured by the pressure sensor (5) with the first threshold value (Pe1) and the second threshold value (Pe2) and if Pa2 is smaller than Pe1, than decides that the laundry type is "cotton." If the measured instantaneous pressure value (Pa2) is greater than the second threshold value (Pe2), then the control unit (6) decides that the laundry type is "synthetic". If the instantaneous pressure value (Pa2) remains between the first threshold value (Pe1) and the second threshold value (Pe2), then the control unit (6) decides that the laundry type is "mixed".

After determining the laundry type, the control unit (6) provides water to be received into the tub (3) that is necessary for executing the washing program by opening/closing the valve (4). The control unit (6) opens the valve (4) when the pressure values measured by the pressure sensor (5) reach the respective opening pressure level (Pva1) according to the determined laundry type and closes the valve (4) when the pressure values measured by the pressure sensor (5) reach the respective closing pressure level (Pvu1) according to the determined laundry type. At the end of the water receiving process, the control unit (6) determines the amount of laundry by comparing the number of valve (4) openings (V) in the water receiving step with the threshold values (M1, M2, . . . ) prerecorded in the memory thereof by the producer.

By means of the washing machine (1) of the present invention, first the type of the laundry placed in the drum (2) is determined and the amount of laundry is estimated correctly by means of using the detected laundry type information in determining the opening pressure level (Pva1) and the closing pressure level (Pvu1).

It is to be understood that the present invention is not limited to the embodiments disclosed above and a person skilled in the art can easily introduce different embodiments. These different embodiments should also be considered within the scope of the claims of the present invention.

The invention claimed is:

1. A washing machine (1) comprising a drum (2) wherein laundry to be washed is placed, a tub (3) wherein the drum (2) is disposed, a valve (4) that provides water to be received by opening/closing a water conduit, a pressure sensor (5) that detects a pressure exerted by the water received into the tub (3) and a control unit (6) that determines a type and amount of the load by evaluating the data received from the pressure sensor (5), wherein the control unit (6) configured to:

a. provide water to be received by opening the valve (4) at the start of the washing program until a water height in the tub (3) reaches a level to wet the laundry without entirely saturating the laundry with water, b. measuring the pressure by the pressure sensor (5) after the drum (2) is rotated to provide measured instantaneous pressure values (Pa1, Pa2, . . . ), c. determine a laundry type by comparing the instantaneous pressure values (Pa1, Pa2, . . . ) measured at a particular point in time with threshold values (Pe1, Pe2, . . . ) prerecorded in a memory thereof by a producer, d. determine according to the laundry type determined by c. (above) a valve (4) closing pressure level (Pvu1, Pvu2, . . . ) value and a valve (4) opening pressure level (Pva1, Pva2, . . . ) value on the basis of different values for each laundry type that are prerecorded in the memory, e. execute a water receiving step by opening/closing the valve (4) according to the determined different valve (4) closing pressure level (Pvu1, Pvu2, . . . ) values for each laundry type and different valve (4) opening pressure level (Pva1, Pva2, . . . ) values, f. determine an amount of laundry by comparing a number of the valve (4) openings (V) in the water receiving step with threshold values (M1, M2, . . . ) prerecorded in the memory thereof by the producer.

2. The washing machine (1) as in claim 1, wherein the control unit (6) that compares the instantaneous pressure value (Pa1) measured by the pressure sensor (5) with a first threshold value (Pe1) and a second threshold value (Pe2) that is greater than the first threshold value (Pe1) and if Pa1 is smaller than Pe1 , then decides that the laundry type is "cotton", if the measured instantaneous pressure value (Pa1) is greater than the second threshold value (Pe2), then decides that the laundry type is "synthetic".

3. The washing machine (1) as in claim 1, wherein the control unit (6) that compares the instantaneous pressure value (Pa2) measured by the pressure sensor (5) with a first threshold value (Pe1) and a second threshold value (Pe2) that is greater than the first threshold value (Pe1) and if Pa2 is smaller than Pe1, then decides that the laundry type is "cotton", if the measured instantaneous pressure value (Pa2) is greater than the second threshold value (Pe2), then decides that the laundry type is "synthetic" and if the instantaneous pressure value (Pa2) remains between the first threshold value (Pe1) and the second threshold value (Pe2), then decides that the laundry type is "mixed".

* * * * *